US007058990B1

(12) United States Patent
Lan

(10) Patent No.: US 7,058,990 B1
(45) Date of Patent: Jun. 13, 2006

(54) LIGHTWEIGHT LENS RETAINER'S DIVING MASK

(76) Inventor: Shun-Nan Lan, No. 3, Lane 183, Chung Hsing Rd., Hsi Chih City, Taipei Hsiang (TW)

( * ) Notice: Subject to any disclaimer, the term of this patent is extended or adjusted under 35 U.S.C. 154(b) by 0 days.

(21) Appl. No.: 11/006,677

(22) Filed: Dec. 8, 2004

(51) Int. Cl.
*A61F 9/02* (2006.01)

(52) U.S. Cl. ..... 2/428

(58) Field of Classification Search ..... 2/428, 2/429, 439, 447; 351/43
See application file for complete search history.

(56) References Cited

U.S. PATENT DOCUMENTS 3,945,044 A * 3/1976 McGee et al. ..... 2/436
5,410,763 A * 5/1995 Bolle ..... 2/436
5,479,917 A * 1/1996 Hsieh ..... 128/200.29
6,532,603 B1 * 3/2003 Lan ..... 2/428
6,749,299 B1 * 6/2004 Hsu ..... 351/62

* cited by examiner

*Primary Examiner*—Katherine M. Moran
(74) *Attorney, Agent, or Firm*—Birch, Stewart, Kolasch & birch, LLP

(57) ABSTRACT

Provided is a lightweight lens retainer's diving mask comprising a waterproof plastic head covering, a frame formed forwardly of the head covering, the frame including holes spaced around its inner edge, an integral, elongate lens including two notches formed at both sides of its nose portion, and a separate retainer including tabs spaced around its outer edge, and two projections formed at both sides of its nose portion. The lens is fitted in an innermost position of the frame, the retainer is disposed forwardly of the lens, the projections are inserted into the notches, and the tabs are inserted into the holes for sealingly assembling the frame, the lens, and the retainer together by a retaining operation. The invention has advantages such as reliable fastening, lightweight, reduction in the cost related to machining and molding.

2 Claims, 4 Drawing Sheets

LIGHTWEIGHT LENS RETAINER'S DIVING MASK

FIELD OF THE INVENTION

The present invention relates to diving masks and more particularly to a lightweight lens retainer's diving mask having a snapping based lens retaining mechanism as a replacement of prior mode of molded plastic and then assembly, thereby reducing the manufacturing cost, making the whole structure light in weight, and thus bringing a degree of comfort to the face of a wearer.

BACKGROUND OF THE INVENTION

A typical diving mask is shown in FIG. 4 and comprises a waterproof head covering 10 formed of plastic, a thicker frame 20 provided forwardly of the head covering 10, the frame 20 having a plurality of holes 21 spaced around its inner edge, an integral, elongate lens 40, and a waterproof border member 30 with the lens 40 formed therein, the border member 30 having a plurality of tabs 31 spaced around its outer edge.

In assembly, align the tabs 31 with the holes 21. Next, snap the tabs 31 into the corresponding holes 21 for coupling the border member 30 and the frame 20 together. Note that the head covering 10 and the frame 20 has been assembled together and the border member 30 and the lens 40 has been assembled together respectively prior to the assembly. Thus, a complete diving mask is formed.

However, the prior diving mask has a number of drawbacks. For example, the border member 30 is secured around the lens 40 by adhesive with a peripheral projection of certain thickness formed at each of front and rear edges of the lens 40. The head covering 10 is adapted to fit with the frame 20 and in turn the frame 20 is adapted to fit with the heavy border member 30 and the lens 40. As such, a front portion of the head covering 10 is projected excessively in order to assemble the border member 30 and the lens 40 with the frame 20 as indicated by thickness D. As a result, the head covering 10 or thus the diving mask is relatively heavy (i.e., somewhat bulky). A person wearing the head covering 10 may feel a degree of discomfort on his/her face. Moreover, the border member 30 is formed around the lens 40 by injection molding and the tabs 31 of the formed border member 30 have to align with the holes 21 prior to assembly. This means that a precise alignment must be carried out in the manufacturing process. Otherwise, the assembly may fail. This inevitably will increase cost related to machining and molding. Thus, it is desirable to provide a novel diving mask without the above drawbacks of prior art.

SUMMARY OF THE INVENTION

It is an object of the present invention to provide a lightweight lens retainer's diving mask in which the head covering, the lens, and the retainer are separate prior to assembly by a simple retaining operation. By utilizing this, advantages such as reliable fastening, lightweight, and reduction in the cost related to machining and molding can be obtained.

The advantages of the present invention are realized by providing a lightweight diving mask comprising a waterproof plastic head covering; a frame formed forwardly of the head covering, the frame including a plurality of holes spaced around its inner edge; an integral, elongate lens including two notches formed at first predetermined positions; and a separate retainer including a plurality of tabs spaced around its outer edge and being disposed in a corresponding relationship with respect to the holes, and two projections formed at second predetermined positions in a corresponding relationship with respect to the first predetermined positions, wherein the lens is fitted in an innermost position of the frame, the retainer is disposed forwardly of the lens, the projections are inserted into the notches, and the tabs are inserted into the holes for sealingly assembling the frame, the lens, and the retainer together by a retaining operation.

The above and other objects, features and advantages of the present invention will become apparent from the following detailed description taken with the accompanying drawings.

DETAILED DESCRIPTION OF THE PREFERRED EMBODIMENTS

Figure 1:
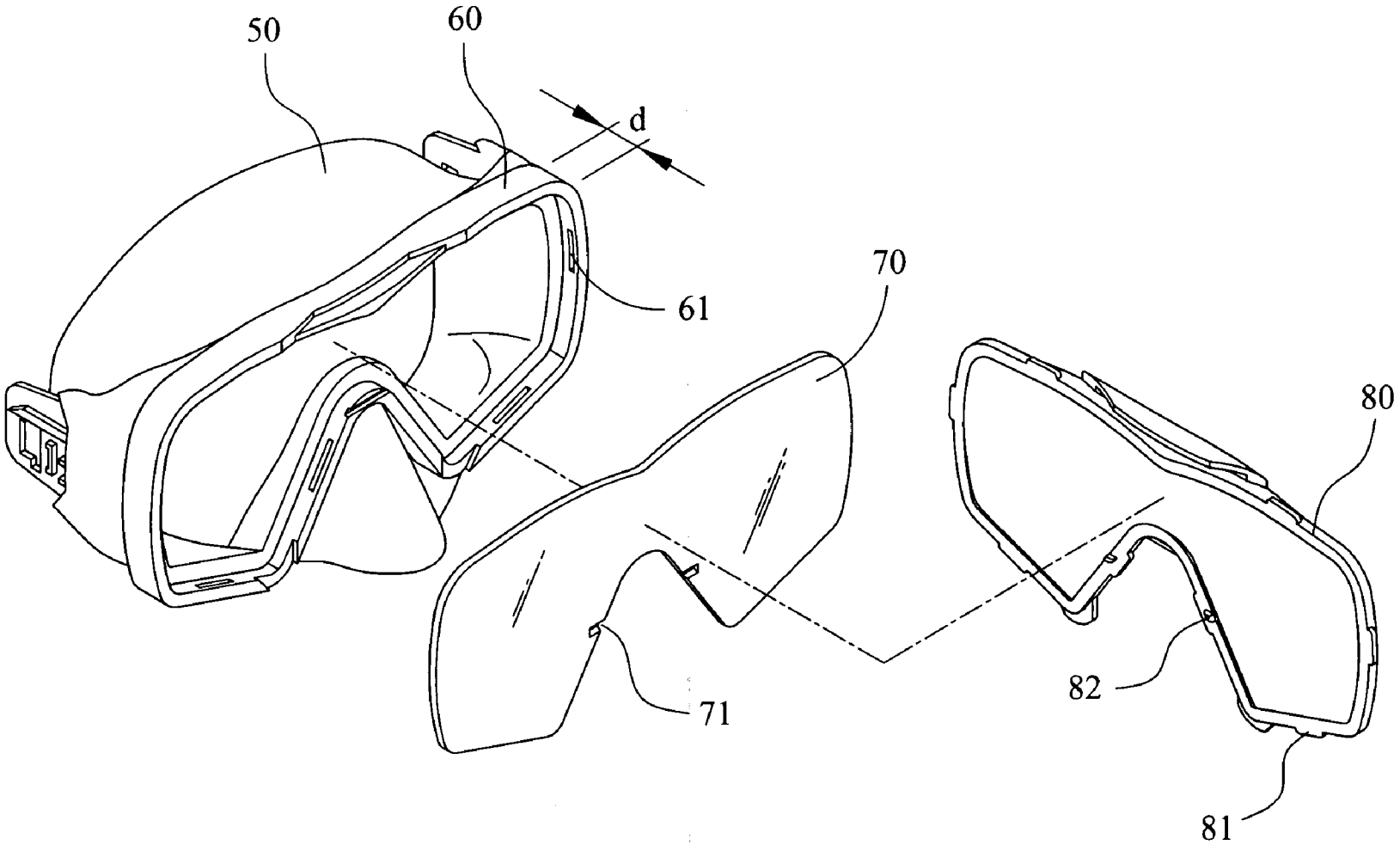
FIG. 1 is an exploded perspective view of a diving mask according to a preferred embodiment of the invention.
Figure 2:
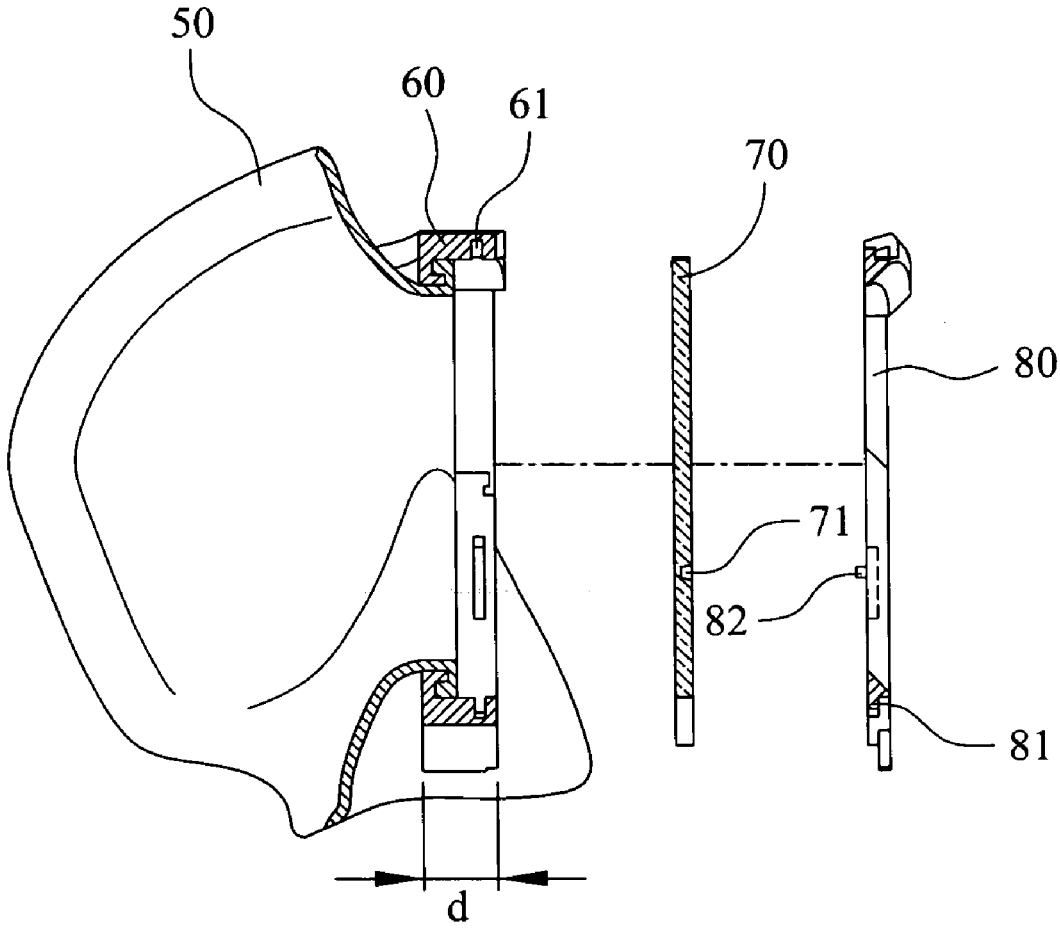
FIG. 2 is a side view in part section of the diving mask prior to assembly.
Figure 3:
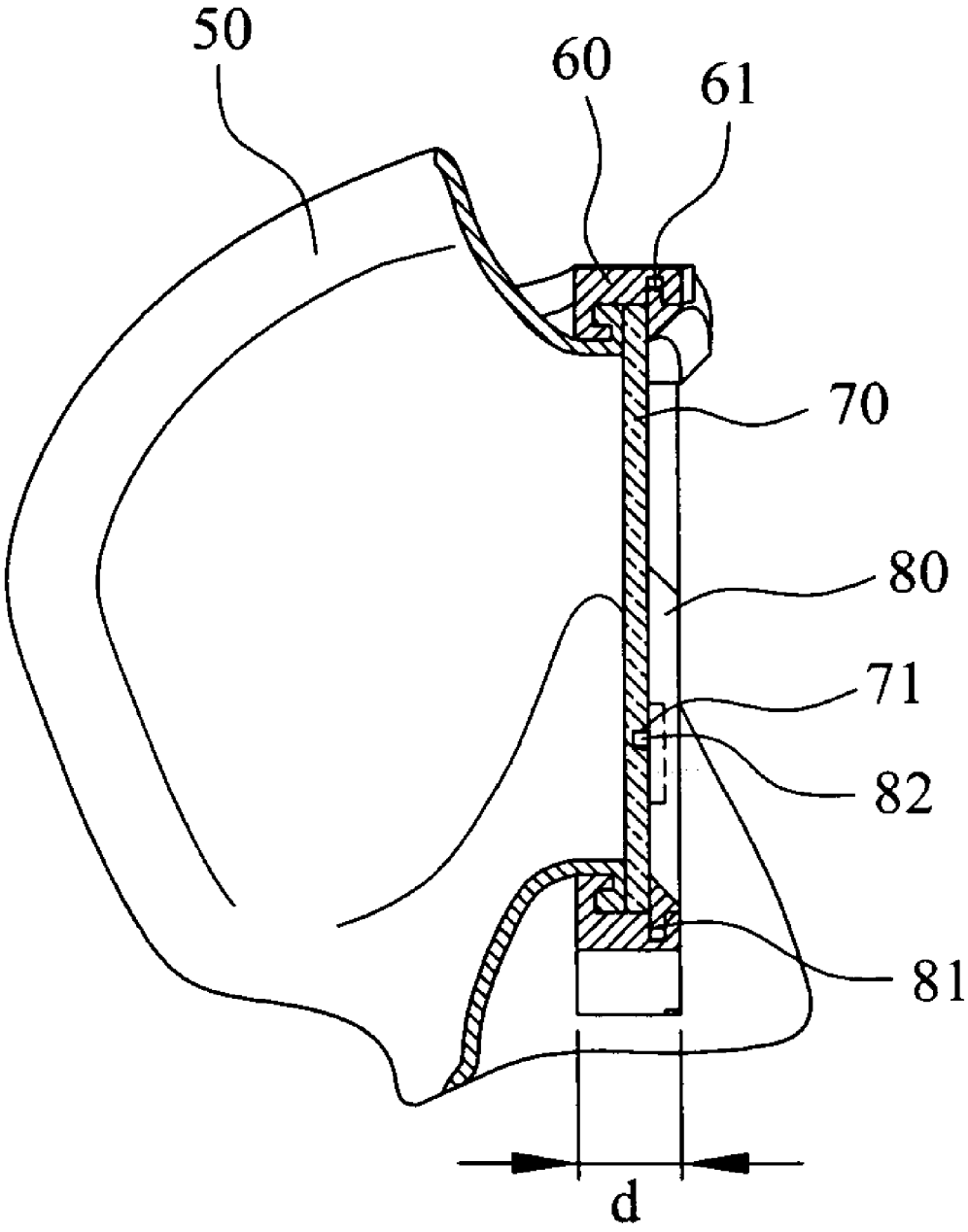
FIG. 3 is a view similar to FIG. 3 in which the diving mask has been assembled.

Referring to FIGS. 1 to 3, there is shown a diving mask according to a preferred embodiment of the invention. The diving mask comprises a waterproof plastic head covering 50, a thicker frame 60 provided forwardly of the head covering 50, the frame 60 having a plurality of holes 61 spaced around its inner edge, the frame 60 having a thickness d smaller than thickness D of the prior art, an integral, elongate lens 70 having two opposite notches 71 at both sides of its nose portion, and a separate retainer 80 shaped and dimensioned to fit the lens 70 therein as detailed later. The retainer 80 includes a plurality of tabs 81 spaced around its outer edge and two opposite projections 82 at both sides of its nose portion.

All of the tabs 81 and the projections 82 are formed in a corresponding relationship with respect to the holes 61 and the notches 71 respectively. Thus, in assembly, first fit the lens 70 in an innermost position of the frame 60. Next, couple the retainer 80, the lens 70, and the frame 60 together by a simple retaining operation with the retainer 80 being disposed forwardly of the lens 70, the projections 82 being inserted into the notches 71, and the tabs 81 being inserted into the holes 61. As a result, a waterproof diving mask is formed by the sealingly assembled frame 60, lens 70, and retainer 80. Note that the frame 60 is formed together with the head covering 50 prior to the assembly and the joining portion of the frame 60 and the head covering 50 is also waterproof.

Figure 4:
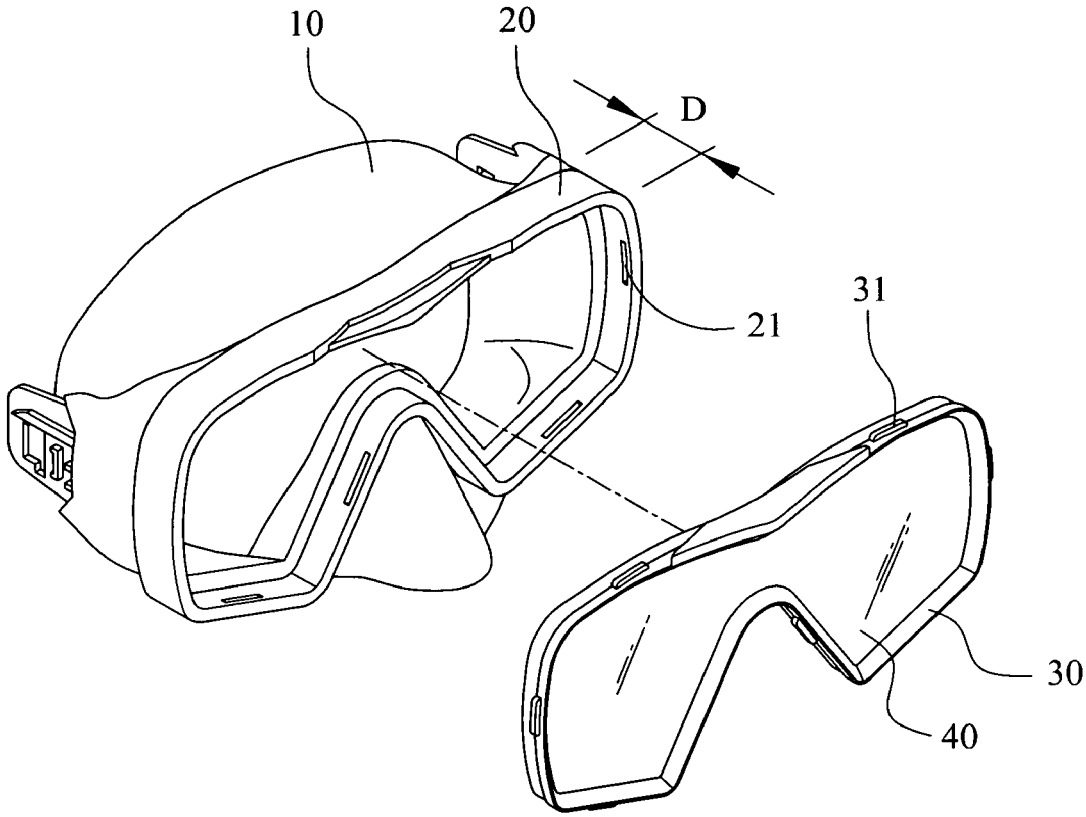
Fig.4 Prior Art
FIG. 4 is an exploded perspective view of a prior diving mask.

The invention has the following advantages. As shown in FIGS. 2 and 3, the fitted lens 70 is located in an innermost position of the frame 60 and the retainer 80 is disposed forwardly of the lens 70. As such, thickness of the retainer 80 is about half of thickness of the prior border member 30 fitted with lens (see FIG. 4). That is, a thickness d of the frame 60 fitted with the lens 70 is smaller, resulting in a reduction in the weight, material saving, and thus bringing a degree of comfort to the face of a wearer. Moreover, molding cost is saved since the retainer is not formed around the lens by injection molding. And in turn it enables the manufacturers to have more choice in selecting a desired material of the diving mask, resulting in a further reduction in the manufacturing cost.

While the invention herein disclosed has been described by means of specific embodiments, numerous modifications and variations could be made thereto by those skilled in the art without departing from the scope of the invention set forth in the claims.

What is claimed is:

1. A lightweight diving mask comprising:

a waterproof plastic head covering;

a frame formed forwardly of the head covering, the frame including a plurality of holes spaced around its inner edge;

an integral, elongate lens including two notches formed at first predetermined positions; and a separate retainer including a plurality of tabs spaced around its outer edge and being disposed in a corresponding relationship with respect to the holes, and two projections formed at second predetermined positions in a corresponding relationship with respect to the first predetermined positions, wherein the lens is fitted in an innermost position of the frame, the retainer is disposed forwardly of the lens, the projections are inserted into the notches, and the tabs are inserted into the holes for sealingly assembling the frame, the lens, and the retainer together by a retaining operation.

2. The diving mask of claim 1, wherein the first predetermined positions of the notches are both sides of a nose portion of the lens and the second predetermined positions of the projections are both sides of a nose portion of the retainer.

* * * * *